US011241122B2

(12) United States Patent
Casayuran

(10) Patent No.: US 11,241,122 B2
(45) Date of Patent: Feb. 8, 2022

(54) MATERIAL ROLL DISPENSER WITH ADJUSTABLE SUPPORT ARMS

(71) Applicant: Fae Casayuran, Kahului, HI (US)

(72) Inventor: Fae Casayuran, Kahului, HI (US)

(73) Assignee: Fae Casayuran, Kahului, HI (US)

( * ) Notice: Subject to any disclaimer, the term of this patent is extended or adjusted under 35 U.S.C. 154(b) by 80 days.

(21) Appl. No.: 16/576,825

(22) Filed: Sep. 20, 2019

(65) Prior Publication Data

US 2020/0008629 A1 Jan. 9, 2020

Related U.S. Application Data

(63) Continuation of application No. PCT/US2018/022343, filed on Mar. 20, 2018.

(60) Provisional application No. 62/475,745, filed on Mar. 23, 2017.

(51) Int. Cl.
*A47K 10/22* (2006.01)
*A47K 10/40* (2006.01)

(52) U.S. Cl.
CPC ..... *A47K 10/22* (2013.01); *A47K 10/40* (2013.01)

(58) Field of Classification Search
CPC ..... A47K 10/22; A47K 10/40; A47K 10/38; A47K 2010/389; Y10S 242/905; B65H 16/06
USPC ... 242/560.2, 561, 578, 578.1, 578.2, 578.3, 242/596, 596.1, 596.4, 596.5
See application file for complete search history.

(56) References Cited

U.S. PATENT DOCUMENTS 1,187,705 A * 6/1916 Calvert ..... B65H 16/06 242/423
2,025,732 A * 12/1935 Dodelin ..... A47K 10/3836 242/560
3,088,686 A * 5/1963 Curry ..... A47K 10/40 242/596.1
3,799,467 A * 3/1974 Bauman ..... A47K 10/3836 242/560
4,097,002 A * 6/1978 Krueger ..... A47K 10/40 242/160.1
4,105,168 A * 8/1978 Rutherford ..... A47K 10/40 242/596.1
4,614,312 A * 9/1986 Del Pino ..... A47K 10/40 242/596.4
4,834,316 A * 5/1989 DeLorean ..... A47K 10/32 242/594
5,248,105 A * 9/1993 Cooker ..... A47K 10/38 242/598.5
5,605,250 A * 2/1997 Meiron ..... A47K 10/38 221/33
5,950,961 A * 9/1999 Duck ..... A47K 10/40 242/596.1
6,755,382 B1 * 6/2004 Melnick ..... A47K 10/38 242/596.1
6,761,298 B1 * 7/2004 Cantrell ..... B65H 35/002 225/42
2007/0158489 A1 * 7/2007 Anderson ..... A47K 10/40 242/596.4
2011/0215187 A1 * 9/2011 Owurowa ..... A47K 10/38 242/550

(Continued)

*Primary Examiner* — William A. Rivera
(74) *Attorney, Agent, or Firm* — Jeremy Forest; Manoa Law Group

(57) ABSTRACT

Material roll dispenser devices having adjustable support arms. Exemplary devices include those suitable for dispensing paper products such as toilet paper.

3 Claims, 5 Drawing Sheets

100

(56) References Cited

U.S. PATENT DOCUMENTS

2018/0020886 A1* 1/2018 Boeltl ..... A47K 10/40
242/596.4

* cited by examiner

100

2

MATERIAL ROLL DISPENSER WITH ADJUSTABLE SUPPORT ARMS

CROSS REFERENCE TO RELATED APPLICATIONS

This application is a continuation of PCT/US18/23343, filed Mar. 20, 2018, which claims the benefit under 35 U.S.C. § 119(e) of U.S. Provisional Patent Application No. 62/475,745, filed Mar. 23, 2017, which is incorporated herein by reference in its entirety for all purposes.

FIELD

The present disclosure relates to a material role dispenser such as, for example, a dispenser that is capable of dispensing paper products such as toilet paper.

BACKGROUND

Conventional toilet paper dispensers are designed to hold a single-sized toilet paper roll, wherein the mechanism adapted to support the roll cannot be adjusted to accommodate the width of larger rolls sizes. Moreover, most dispensers comprise a fixed housing with rigid (non-adjustable) arms and a compressible cross-bar engaged between the rigid arms of the housing. To mount or dismount a roll of material on the dispenser, the user is required to use both hands to simultaneously compress the cross-bar and pull the cross-bar away from the arms. As may be appreciated, the physical ability, e.g., the strength and coordination, required to perform this task may be outside the abilities of some people, such as the elderly, the young, or the disabled. Accordingly, there remains a need for material roll dispensers that are capable of handling rolls of varying size/width, as well as allowing for ease in loading and reloading the dispenser.

SUMMARY

Described herein are material dispenser devices, systems, and kits comprising adjustable support arms. In certain embodiments the device may be implemented to dispense paper products such as toilet paper. In certain embodiments, the device comprises:

a backing plate adapted to attach to a substrate, said backing place having a horizontal plane;

two adjustable arms associated with the backing plate, said adjustable arms being substantially parallel to each other and configured to extend outwardly from the backing plate to define a space having a width, wherein the adjustable arms each have an opening, and wherein the adjustable arms are configured to alter the width of the space by repositioning said arms along the horizontal plane; and a retractable plunger associated with each opening, wherein the retractable plungers comprise a generally hemispherical in shape and protrude from the openings in a manner that is substantially perpendicular to the adjustable arms, wherein each retractable plunger is adapted to retract within the opening of the adjustable arm upon application of an external force.

Also described herein are kits, said kits comprising the dispenser device described above, along with written or pictorial instructions for installing and/or assembling the device.

DETAILED DESCRIPTION

While the following describes exemplary embodiments of the devices, systems, and kits described herein, it is understood that the description is made by way of example and is not intended to limit the scope of the general inventive concepts set forth herein. It is expected that alterations and further modifications, as well as other and further applications of the principles, may occur to others skilled in the art and, to the extent they differ from the foregoing, shall remain within the spirit and scope of the instant disclosure.

Described herein are material dispensing devices suitable for dispensing products such as toilet paper.

Figure 1:
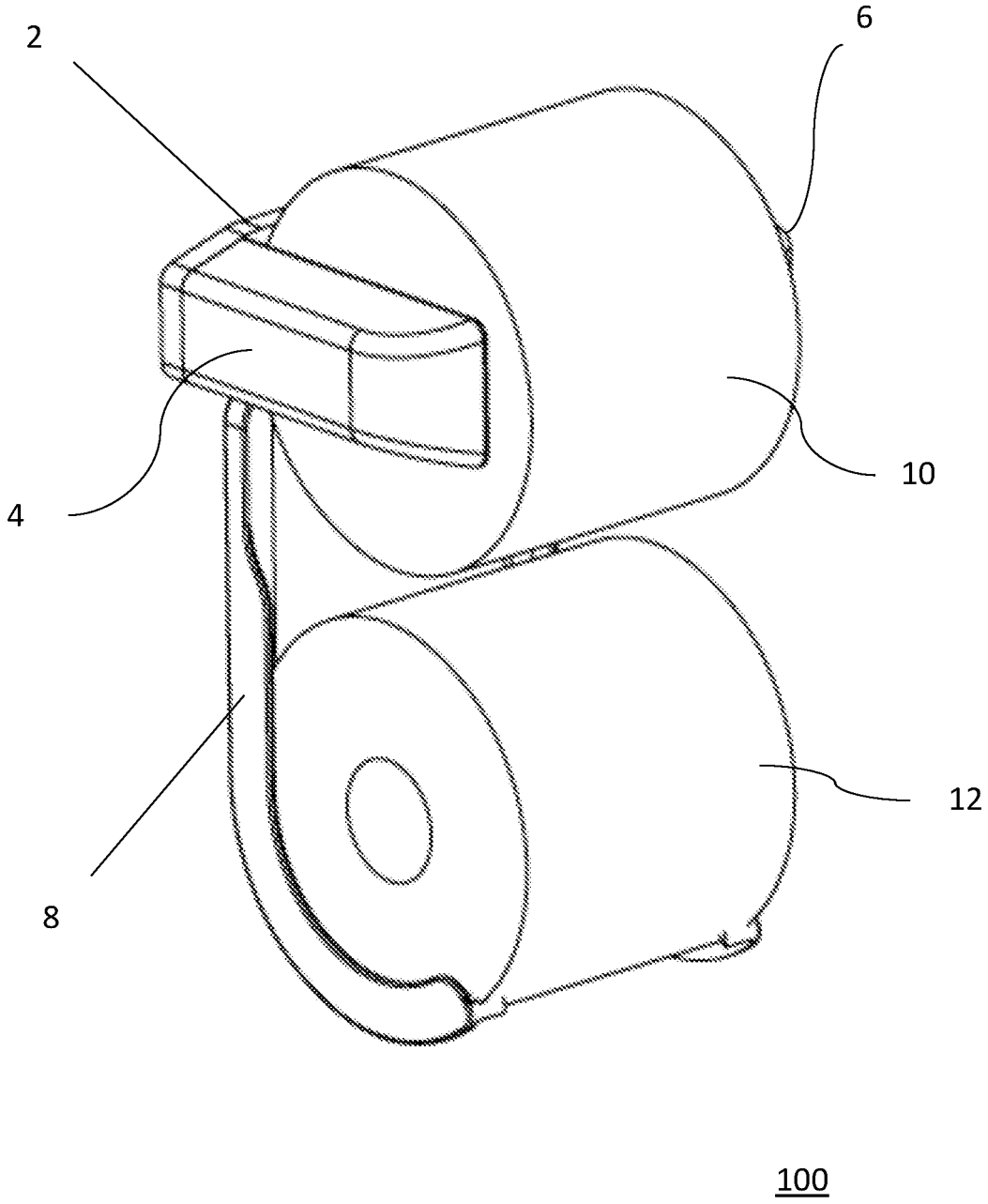
FIG. 1 is a front perspective view of an exemplary dispensing device comprising a primary paper roll and a secondary paper roll.

FIG. 1 illustrates exemplary dispenser device 100, which comprises backing plate 2, left adjustable arm 4, right adjustable arm 6, and reloading structure 8. Adjustable arms 4 and 6 extend outwardly from backing plate 2, and define a space having a width. As described further below, the width of the space may be varied by repositioning one or more of adjustable arms 4 and 6 along the horizontal plane of backing plate 2 to accommodate material rolls of varying size, such as primary paper roll 10. Optionally, device 100 may further comprise reloading structure 8, which may be associated with backing plate 2 and is designed to accommodate secondary roll 12. Upon depletion of primary roll 10, a user can reposition secondary roll 12 into a primary position between arms 4 and 6. Reloading structure 8 can be of any design suitable to support a secondary roll, such as the hanger mechanism reflected in device 100 which is J-shaped and is designed to cradle secondary roll 12. Generally, device 100 can be constructed from any suitable materials known to those of skill in the art, including wood, metal, plastic, polymeric composites, recycled materials, and combinations thereof. Components of the device can be prepared through any suitable machining or molding techniques, such as 3D printing, injection molding, etc.

Figure 2:
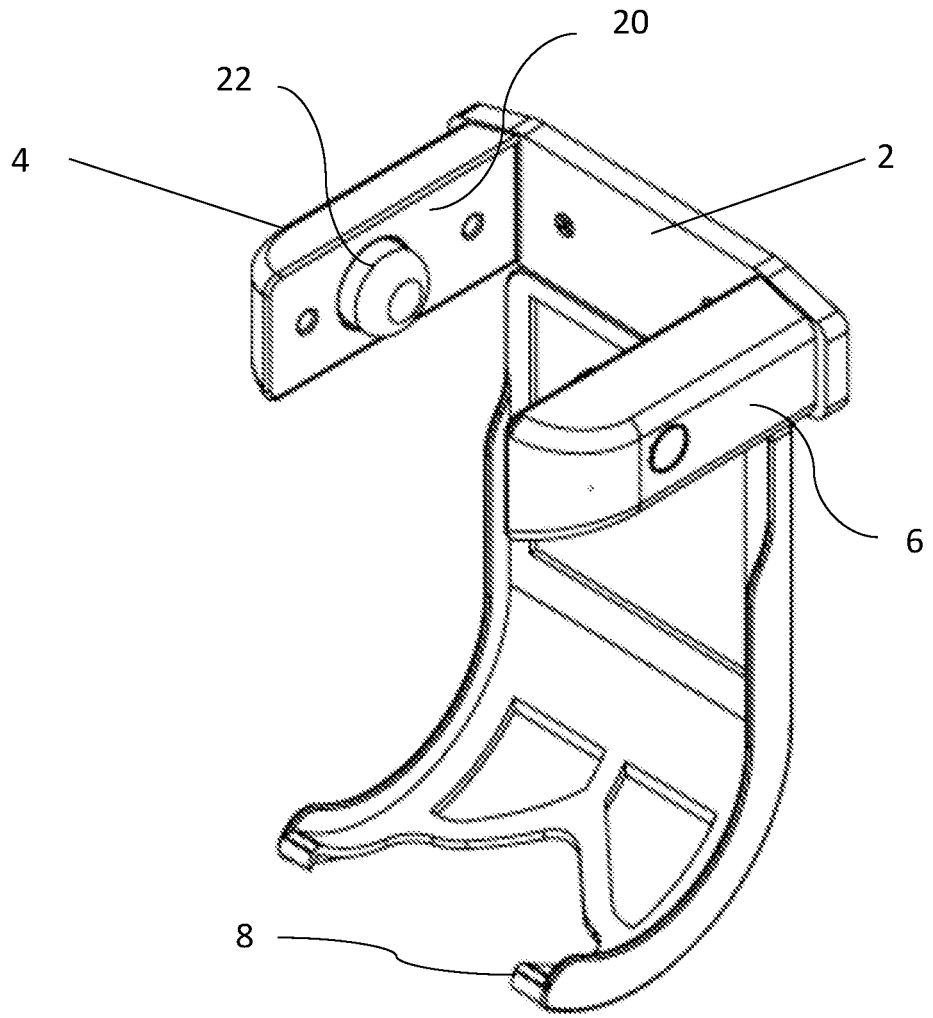
FIG. 2 is a front perspective view of an exemplary dispensing device with the primary and secondary paper rolls removed.
Figure 3A:
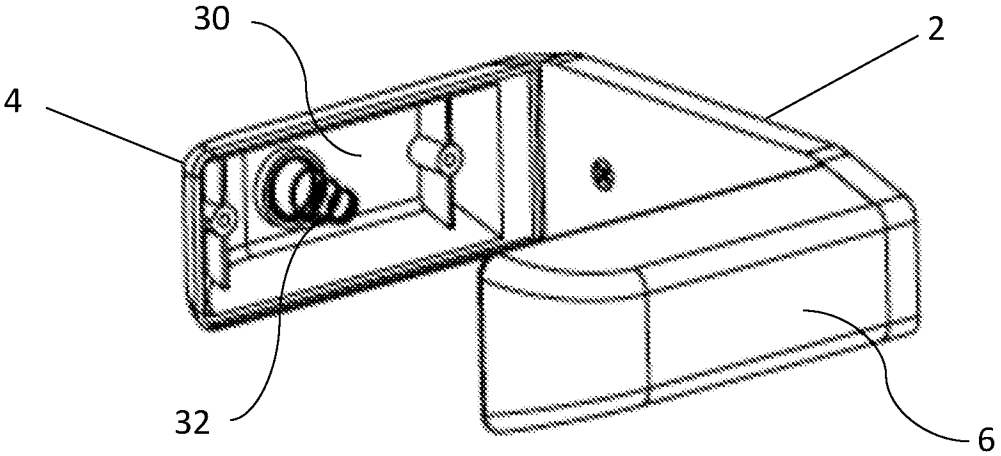
FIG. 3A is a front perspective view of an exemplary dispensing device with a retainer plate and retractable plunger removed.
Figure 3C:
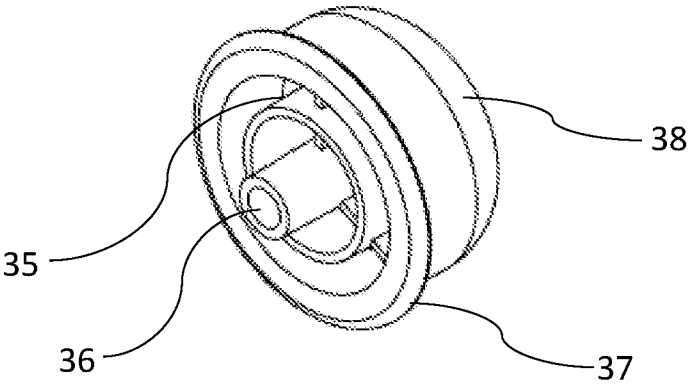
FIG. 3C is a rear perspective view of an exemplary retractable plunger.
Figure 3B:
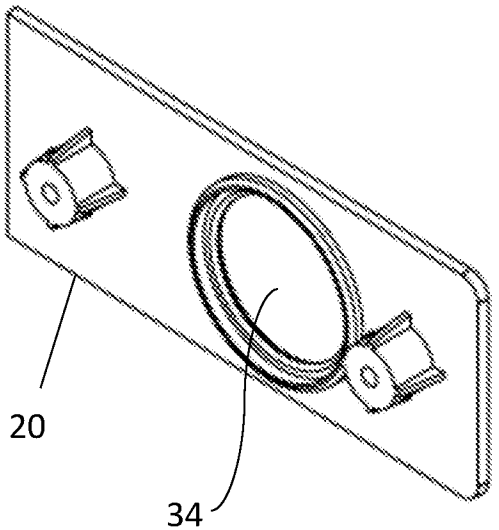
FIG. 3B is a rear perspective view of an exemplary retainer plate.

FIG. 2 illustrates the components of the adjustable arm structure in more detail. Arm 4 comprises retractable plunger 22 and outer retainer plate 20. FIG. 3A illustrates the inner mechanism of adjustable arm 4 upon removal of outer retainer plate 20 and retractable plunger 22. More specifically, the inner portion of arm 4 comprises inner catch surface 30, which is designed to retain spring 32 and provide a backstop to plunger 22. FIG. 3B presents a backside view of outer retainer plate 20, which defines opening 34. FIG. 3C presents a backside view of plunger 22, which comprises outer catch surface 35, front hemispherical surface 38, annular retainer 37, and female engager 36. When assembled, spring 32 engages with outer catch surface 35 of plunger 22. To help maintain plunger 22 in a perpendicular plane with arm 4, a male engager may be associated with inner catch surface 30 and positioned inside of spring 32 to receive female engager 36. Hemispherical surface 38 is then passed through opening 34 of outer retainer plate 20, which is then affixed to become a part of arm 4 by one or more screws. Annular retainer 37 is larger in diameter than opening 34, such that when spring 32 biases plunger 22, retainer 37 rests against the inner surface of retainer plate 20 and, thus, retains plunger 22 within arm 4. When an outer force (e.g., a toilet paper roll) is applied to hemispherical surface 38 from any direction (i.e., above arms, below arms, or in front of arms), plunger 22 compresses spring 32 and plunger 22 retracts within the arm. When the force is removed, e.g., when plunger 22 encounters the hollow core of a toilet paper roll (or the hollow center of a coreless roll), plunger 22 is allowed to again protrude from opening 34 via spring 32 and can engage with the hollow space defined by the core, thus allowing arms 4 and 6 to suspend roll 10 in the space between the arms. Given the spring-loaded nature of plungers 22, the core of the spent roll can be just as easily removed from any direction by a user, as the force applied to the plungers by of the outer edges of the core leaving the space will again retract the plungers.

Figure 4:
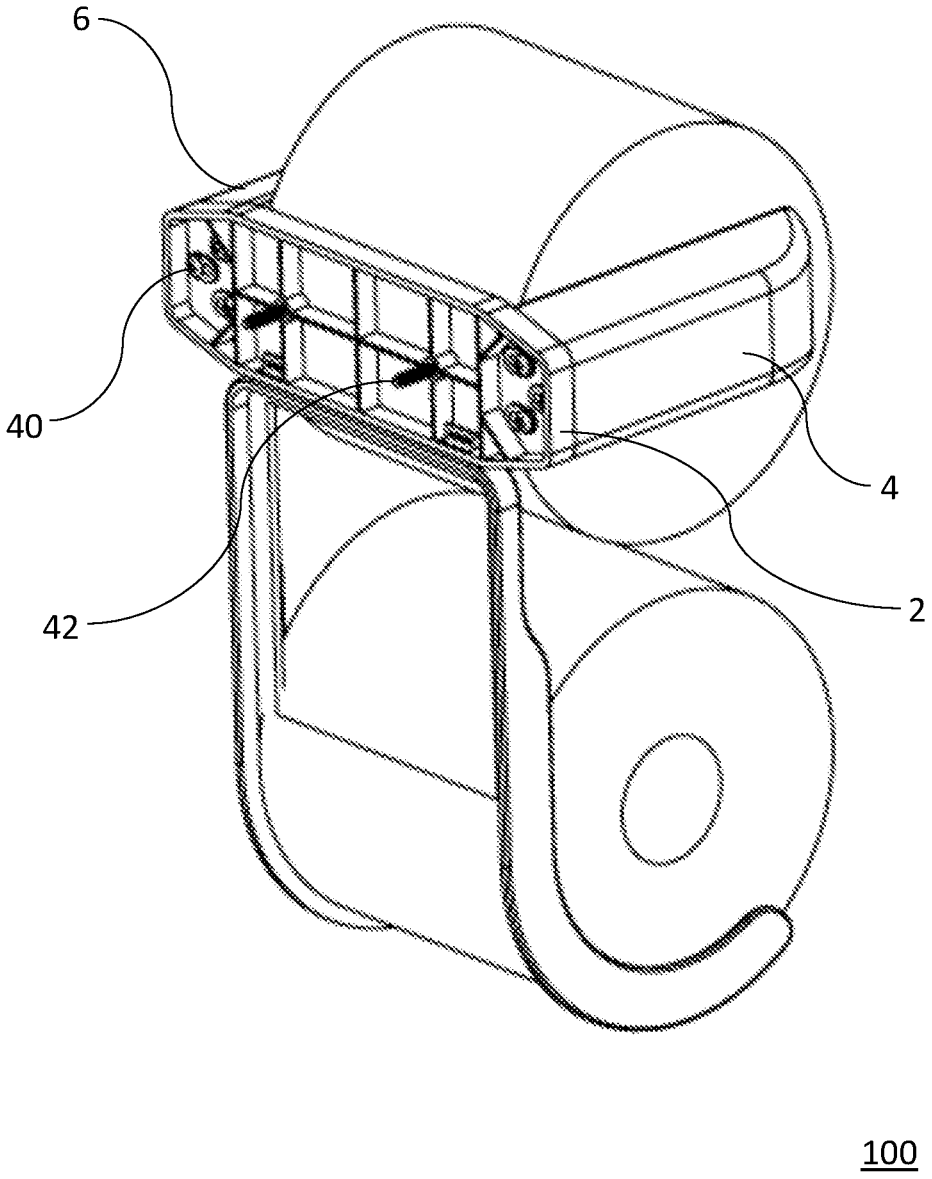
FIG. 4 is a rear perspective view of an exemplary dispensing device.
Figure 5:
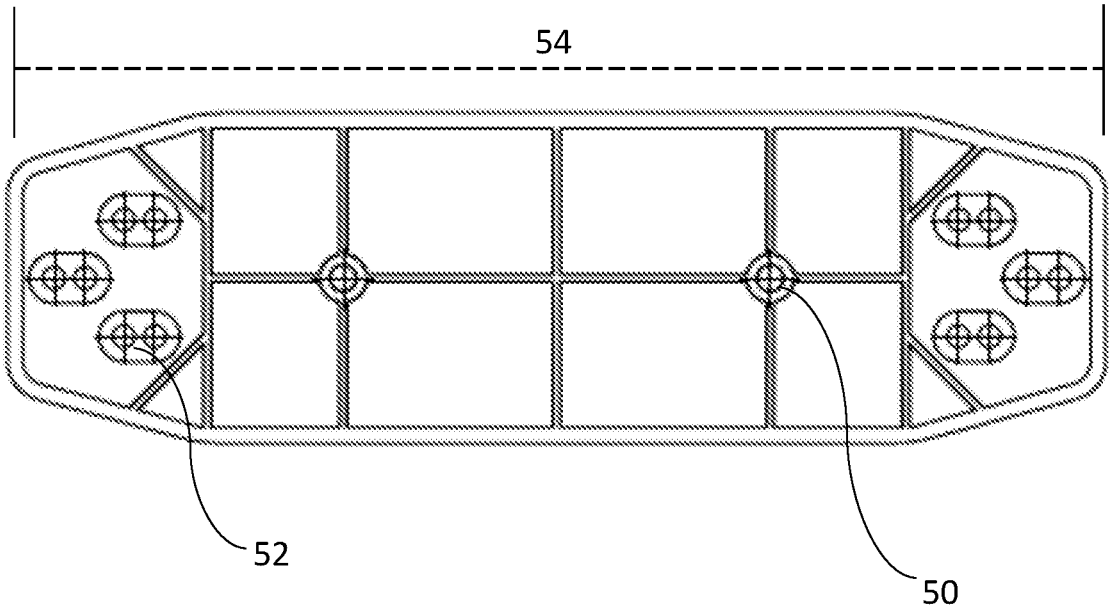
FIG. 5 is a rear view of an exemplary backing plate.

FIG. 4 provides a rear perspective view of device 100. In certain embodiments, arms 4 and 6 are attached to backing plate 2 via adjustable screws 40. In certain embodiments, device 100 may be affixed to a substrate (e.g., bathroom wall) via screws 42 passing through backing plate 2. FIG. 5 provides a rear view of backing plate 2, with horizontal plane 54 representing the area across which adjustable arms 4 and 6 may be positioned along plate 2 to adjust the width of the space defined by the arms. In this example, adjustable screw slots 52 provide different locations for the placement of screws 40, resulting in a different horizontal placement of arms 4 and 6 as they are positioned on the front surface of backing plate 2. Adjustable screw slots 52 may provide multiple screw hole locations along horizontal plane 54. In other embodiments, screw slots 52 may represent slotted holes for which arms 4 and 6 may be repositioned by loosening/tightening screws 40. Screws 52 may be used to affix device 100 to a substrate via apertures 50.

Other embodiments may include kits for assembling and/or mounting device 100. In certain embodiments, the kit will comprise the device or device components, and instructions for installing or assembling the device. The instructions (e.g., written or pictorial) may be provided within the kit (e.g., a paper insert) or printed directly on packaging materials associated with the kit (e.g., paper or plastic). Exemplary written instructions may include directions printed in at least one language, or a URL (web address) designed to link a user to instructions in a digital format. Exemplary pictorial instructions may comprise non-language printed instructions (e.g., small pictures of device components and how they are assembled), or coded instructions (e.g., smart code or bar code). In certain embodiments, the pictorial instructions are configured to link a user with instructions in a digital format, e.g., such as by allowing a user to scan the code with a smart phone or tablet to link the user with digital instructions on their mobile device.

Additional Embodiments

1. A device comprising:
   - a backing plate adapted to attach to a substrate, said backing place having a horizontal plane;
   - two adjustable arms associated with the backing plate, said adjustable arms being substantially parallel to each other and configured to extend outwardly from the backing plate to define a space having a width, wherein the adjustable arms each have an opening, and wherein the adjustable arms are configured to alter the width of the space by repositioning said arms along the horizontal plane; and
   - a retractable plunger associated with each opening, wherein the retractable plungers are generally hemispherical in shape and protrude from the openings in a manner that is substantially perpendicular to the adjustable arms, wherein each retractable plunger is adapted to retract within the opening of the adjustable arm upon application of an external force.

2. The device of embodiment 1, wherein each retractable plunger comprises an annular retainer and an outer catch surface, and wherein each adjustable arm comprises an inner catch surface and an outer retainer plate.

3. The device of embodiment 2, wherein the annular retainer is adapted to engage with the outer retainer plate.

4. The device of any one of embodiments 2-3, wherein each adjustable arm further comprises a spring mechanism positioned between the inner catch surface and outer catch surface.

5. The device of any one of embodiments 1-4, wherein the substrate is a wall.

6. The device of any one of embodiments 1-5, wherein the backing plate is adapted to attach to the substrate by one or more screws.

7. The device of any one of embodiments 1-6, wherein each adjustable arm is adapted to alter the width of the space by repositioning said arm along the horizontal plane via one or more adjustable screw slots.

8. The device of any one of embodiments 1-7, further comprising a reloading structure.

9. The device according to embodiment 8, wherein the reloading structure comprises a hanger mechanism associated with the backing plate and positioned below the adjustable arms.

10. A kit comprising:
   - a device comprising:
     - a backing plate adapted to attach to a substrate, said backing place having a horizontal plane,
     - two adjustable arms associated with the backing plate, said adjustable arms being substantially parallel to each other and configured to extend outwardly from the backing plate to define a space having a width, wherein the adjustable arms each have an opening, and wherein the adjustable arms are configured to alter the width of the space by repositioning said arms along the horizontal plane, and
     - a retractable plunger associated with each opening, wherein the retractable plungers are generally hemispherical in shape and protrude from the openings in a manner that is substantially perpendicular to the adjustable arms, wherein each retractable plunger is adapted to retract within the opening of the adjustable arm upon application of an external force; and
   - written or pictorial instructions for assembling the device or installing the device.

11. The kit of embodiment 10, further comprising a reloading structure.

12. The kit of embodiment 11, wherein the reloading structure comprises a hanger mechanism associated with the backing plate and positioned below the adjustable arms.

13. The kit of any one of embodiments 10-12, wherein the kit comprises written instructions.

14. The kit of embodiment 13, wherein the written instructions comprise instructions written in at least one language.

15. The kit of any one of embodiments 10-14, wherein the instructions comprise pictorial instructions.

16. The kit of embodiment 15, wherein the pictorial instructions comprise a bar code or a smart code.

17. The kit of embodiment 16, wherein the pictorial instructions are configured to link a user with instructions in a digital format.

18. The kit of embodiment 13, wherein the written instructions comprise a web address.

19. The kit of embodiment 18, wherein the written instructions are configured to link a user with instructions in a digital format.

The invention claimed is:

1. A device comprising:

a backing plate adapted to attach to a substrate, said backing place having a horizontal plane;

two adjustable arms associated with the backing plate, said adjustable arms being substantially parallel to each other and configured to extend outwardly from the backing plate to define a space having a width, wherein the adjustable arms each have an opening, wherein the adjustable arms each have a male engager and an inner catch surface, and wherein the adjustable arms are configured to alter the width of the space by repositioning said arms along the horizontal plane;

a retractable plunger associated with each opening, wherein the retractable plungers are generally hemispherical in shape and protrude from the openings in a manner that is substantially perpendicular to the adjustable arms, wherein each retractable plunger is adapted to retract within the opening of the adjustable arm upon application of an external force; and a reloading structure comprising a hanger mechanism associated with the backing plate and positioned below the adjustable arms, wherein each retractable plunger has a female engager for engaging with one of the male engagers, and wherein each retractable plunger comprises an annular retainer and an outer catch surface, wherein each adjustable arm further comprises an outer retainer plate, such that the annular retainer is adapted to engage with the outer retainer plate, wherein each adjustable arm further comprises a spring mechanism positioned between the inner catch surface and the outer catch surface, and wherein each adjustable arm is adapted to alter the width of the space by repositioning said arm along the horizontal plane via one or more adjustable screw slots.

2. The device of claim 1, wherein the substrate is a wall.

3. The device of claim 2, wherein the backing plate is adapted to attach to the substrate by one or more screws.

* * * * *